US005902708A

United States Patent [19]

Gorog et al.

[11] Patent Number: 5,902,708

[45] Date of Patent: May 11, 1999

[54] METHOD OF ELECTROPHOTOGRAPHIC PHOSPHOR DEPOSITION

[75] Inventors: Istvan Gorog, Lancaster, Pa.; James Regis Matey, Mercerville; Robert Edward Simms, Cream Ridge, both of N.J.

[73] Assignee: Thomson Consumer Electronics, Inc., Indianapolis, Ind.

[21] Appl. No.: 08/862,224

[22] Filed: May 23, 1997

[51] Int. Cl.[6] ..... G03C 5/00

[52] U.S. Cl. ..... 430/28; 430/23

[58] Field of Search ..... 430/23, 25, 26, 430/27, 28

[56] References Cited

U.S. PATENT DOCUMENTS

| | | | |
|---|---|---|---|
| 3,558,310 | 1/1971 | Mayaud | 96/36.1 |
| 4,917,978 | 4/1990 | Ritt et al. | 430/23 |
| 4,921,767 | 5/1990 | Datta et al. | 430/23 |
| 5,455,132 | 10/1995 | Ritt et al. | 430/23 |
| 5,455,133 | 10/1995 | Gorog et al. | 430/23 |
| 5,516,387 | 5/1996 | Hoffman | 156/70 |
| 5,519,217 | 5/1996 | Wilbur et al. | 250/326 |
| 5,625,251 | 4/1997 | Nosker eta l. | 313/403 |

*Primary Examiner*—John Goodrow

*Attorney, Agent, or Firm*—Joseph S. Tripoli; Dennis H. Irlbeck; Vincent J. Coughlin, Jr.

[57] ABSTRACT

A method of electrophotographically manufacturing a luminescent line screen 22 within a viewing area of a faceplate panel 12 includes providing a matrix 23 having a border 123 extending beyond the viewing area. A photoreceptor 36 overlies the matrix. The photoreceptor is electrostatically charged and a color selection electrode 25, having a multiplicity of openings therethrough, is mounted therein. The panel 12 is positioned on an exposure device having a multi-position visible light source. A least one series of light exposures utilizes both first and second order illumination to form selectively discharge the photoreceptor 36 in the viewing area and on the border 123 of the matrix. Then, triboelectrically charged, color-emitting phosphor is deposited onto the illuminated areas of the photoreceptor to form phosphor lines in the viewing area and phosphor traps over the matrix border.

6 Claims, 10 Drawing Sheets

123
S(-1)
S(+1)
L(-1)
L(0)
L(+1)
18
23
25
32
34
@ 9:00 O' CLOCK
@ 3:00 O' CLOCK
A(-1)
A(+1)
B(-1)
B(0)
B(+1)

METHOD OF ELECTROPHOTOGRAPHIC PHOSPHOR DEPOSITION

The present invention relates to a method of electrophotographically manufacturing a luminescent screen assembly on an interior surface of a cathode-ray tube (CRT) faceplate using triboelectrically charged phosphors, and more particularly, to a method that minimizes the cross-contamination and misregister of the subsequently-deposited phosphors caused by the charging properties of the previously-deposited phosphors and a matrix border. Furthermore, the method provides improved control of the distribution of the electrophotographically deposited phosphors across the matrix and matrix openings and thereby provides control of the phosphor line shape.

BACKGROUND OF THE INVENTION

In the manufacturing of a luminescent screen by the conventional wet slurry process, the phosphors are deposited into openings formed in a matrix disposed on the interior surface of the faceplate, for example, in the sequence: green, blue and red. This same phosphor deposition sequence is utilized in the electrophotographic screening (EPS) process described in U.S. Pat. No. 4,921,767, issued to Datta et al., on May 1, 1990. For the EPS process, a matrix having a multiplicity of openings into which the phosphors are deposited also is provided on the interior surface of the faceplate panel.

In the BPS process described in the above-referenced patent, dry-powdered, triboelectrically charged, color-emitting phosphors are deposited on a suitably prepared, electrostatically chargeable photoreceptor formed on the matrix. The photoreceptor comprises an organic photoconductive (OPC) layer overlying, preferably, an organic conductive (OC) layer, both of which are deposited, serially, on an interior surface of the CRT faceplate panel. Initially, the OPC layer of the photoreceptor is electrostatically charged to a positive potential using a suitable corona discharge apparatus. Then, selected areas of the photoreceptor are exposed to visible light to discharge those areas without substantially affecting the charge on the unexposed areas. Next, triboelectrically positively charged, green-emitting phosphor is deposited, by reversal development, onto the discharged areas of the photoreceptor to form phosphor lines of substantially uniform width and screen weight. The photoreceptor and the green-emitting phosphor are recharged by the corona discharged apparatus to impart an electrostatic potential thereon. It is desirable that the potential on the photoreceptor be of the same magnitude as that on the previously deposited green-emitting phosphor; however, it has been determined that the photoreceptor and the previously deposited phosphor do not necessarily charge to the same potential. In fact, the charge acceptance of the phosphors is different from the charge acceptance of the photoreceptor. Consequently, when different selected areas of the photoreceptor are exposed to visible light to discharge those areas to facilitate reversal development thereof with triboelectrically positively charged blue-emitting phosphor, the previously deposited green-emitting phosphor retains a positive charge of a different magnitude than the positive charge on the unexposed portion of the photoreceptor. This charge difference influences the deposition of the positively charged blue-emitting phosphor, causing it to be more strongly repelled by the charge on the previously deposited green-emitting phosphor, than by the charge on the unexposed areas of the photoreceptor. This stronger repelling effect of the green-emitting phosphor causes the blue-emitting phosphor to be slightly displaced from its desired location on the photoreceptor. The repelling effect of the prior deposited phosphor is small, nevertheless, the width of the blue-emitting phosphor lines is narrower than desired. The photoreceptor and the green- and blue-emitting phosphors are recharged by the corona discharge apparatus to impart a positive electrostatic charge thereon to facilitate the deposition of the red-emitting phosphor. The photoreceptor and the green- and blue-emitting phosphors each have a positive charge of a different magnitude thereon. Selected areas of the photoreceptor are discharged by exposure to light, while the charge on the unexposed areas of the photoreceptor and on the prior deposited phosphor is unaffected. The triboelectrically positively charged red-emitting phosphor is more strongly repelled by one of the prior deposited phosphors than by the other, in this instance the green-emitting phosphor, causing misregister of the red phosphor as it is deposited onto the discharged areas of the photoreceptor. Again, the effect is small; however, the red phosphor is slightly displaced from its desired location on the photoreceptor, resulting in a narrowing of the red phosphor lines. In addition to the effect of the prior deposited phosphors on latter deposited phosphors, the substantially uniformly charged OPC layer overlying the border of the matrix surrounding the useful screen area, particularly along the sides of the screen at the ends of the major axis, i.e., at the 3 o'clock and 9 o'clock positions, also exerts an effect which distorts the last phosphors lines on each side of the screen.

In order to manufacture a screen by the EPS process without the above described misregister and last line distortions, it is necessary that compensation for the repulsive effect of the matrix and the previously deposited, electrostatically-charged phosphors be provided.

SUMMARY OF THE INVENTION

The invention relates to a method of electrophotographically manufacturing a luminescent line screen within a viewing area of a faceplate panel of a CRT. The faceplate panel has a major axis and a minor axis. A matrix is provided on an interior surface of the faceplate panel and a photoreceptor overlies the matrix. The matrix has a border extending beyond the viewing area of said line screen, at least along the major axis. The method includes the steps of:

- charging the photoreceptor to establish a substantially uniform electrostatic voltage thereon;
- positioning the panel, with a color selection electrode having a multiplicity of openings therethrough mounted therein, on an exposure device having a multi-position visible light source and exposing from at least one position of said light source, through the openings in the color selection electrode, selected areas of the photoreceptor within the viewing area at an angle substantially identical to the angle of the incident electron beam from a first electron gun within said CRT;
- removing the color selection electrode from the panel;
- depositing a triboelectrically charged first color-emitting phosphor onto the illuminated areas of said photoreceptor;
- recharging the photoreceptor and the first color-emitting phosphor with an electrostatic voltage, the voltage on the photoreceptor being different from the voltage on the first color-emitting phosphor;
- repositioning the panel, with the color selection electrode mounted therein, on the exposure device having the multi-position visible light source, and exposing from at least one position of the light source, through the openings in said color selection electrode, selected areas of the photoreceptor within the viewing area at an angle substantially identical to the angle of the incident electron beam from a second electron gun within the CRT, two other of the positions of said light source being displaced by a distance such that the light source images projected through the openings in the color selection electrode provide an offset of one pitch upon selected areas of the photoreceptor within said viewing area as well as a first area outside said viewing area on one side of the major axis, within the border of the matrix;

removing the color selection electrode from the panel;

depositing a triboelectrically charged second color-emitting phosphor onto the illuminated areas of said photoreceptor; and repeating the recharging, panel repositioning, exposing, and deposition steps with a third color-emitting phosphor, to form a luminescent screen.

DETAILED DESCRIPTION OF THE PREFERRED EMBODIMENTS

Figure 1:
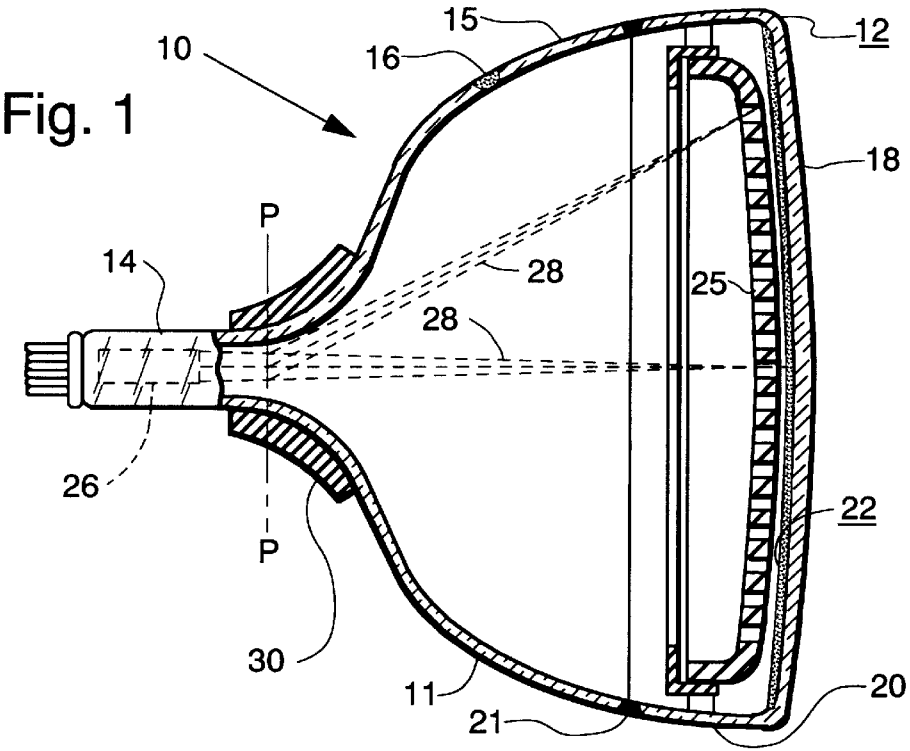
FIG. 1 is a plan view, partially in axial section, of a color CRT made according to the present invention.
Figure 2:
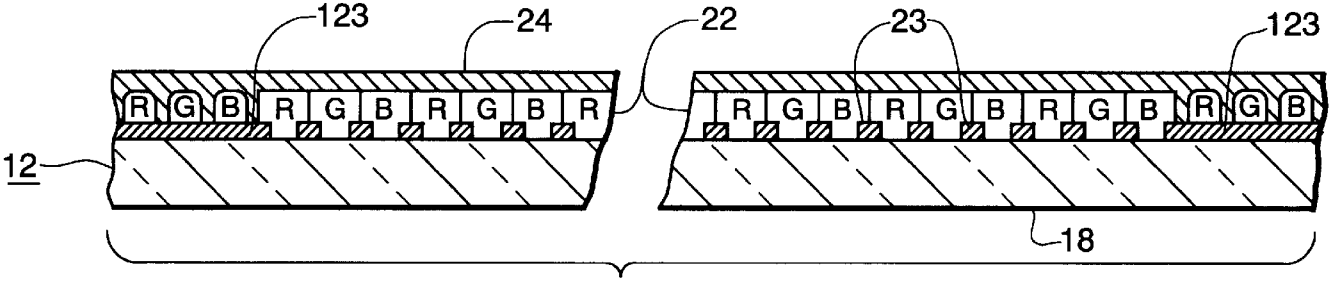
FIG. 2 is a section of a faceplate panel of the CRT of FIG. 1 showing a screen assembly.

FIG. 1 shows a color CRT 10 having a glass envelope 11 comprising a rectangular faceplate panel 12 and a tubular neck 14 connected by a rectangular funnel 15. The faceplate panel 12 has a major axis and a minor axis, as is known in the art. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, is a line screen which includes a multiplicity of screen elements comprised of red-emitting, green-emitting and blue-omitting phosphor stripes Et, G, and B, respectively, arranged in color groups or picture elements of three stripes or triads, in a cyclic order. The stripes extend in a direction which is generally normal to the plane in which the electron beams are generated. In the normal viewing position of the embodiment, the phosphor stripes extend in the vertical direction, that is, parallel to the minor axis. Preferably, at least portions of the phosphor stripes overlap a relatively thin, light absorptive matrix 23, as is known in the art. An imperforate matrix border 123 is provided at the ends of the major axis and extends along the minor axis, at least at the left and right sides of the screen 22. One of each color-emitting phosphor line is deposited on the matrix border 123, for reasons discussed hereinafter. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art. The center-to-center spacing between adjacent electron beams within the electron gun ranges from about 4.1 to 6.6 mm, depending on gun type and tube size.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the deflection zone, are not shown.

Figure 3:
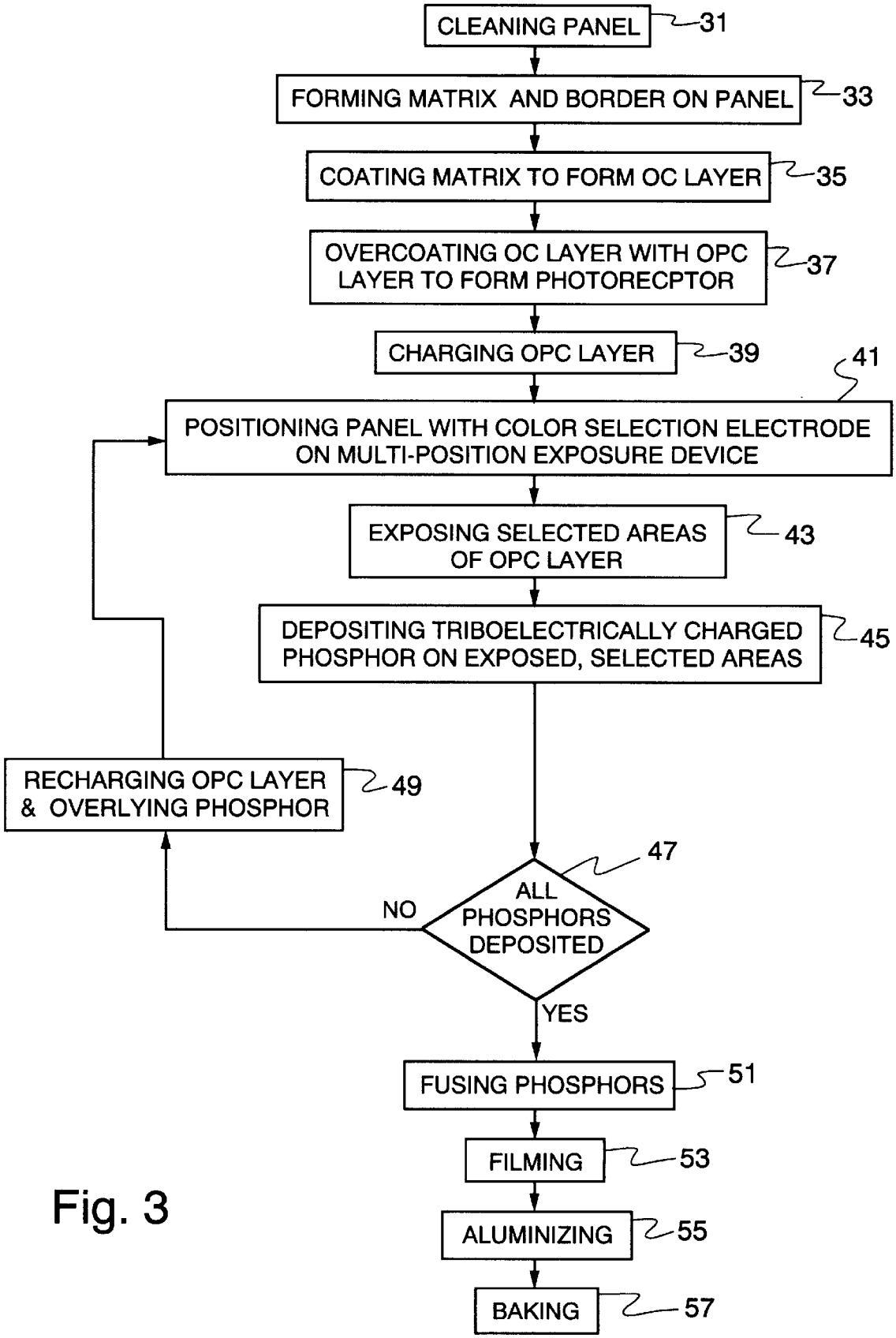
FIG. 3 is a diagram of the novel manufacturing process for the screen assembly.
Figure 4:
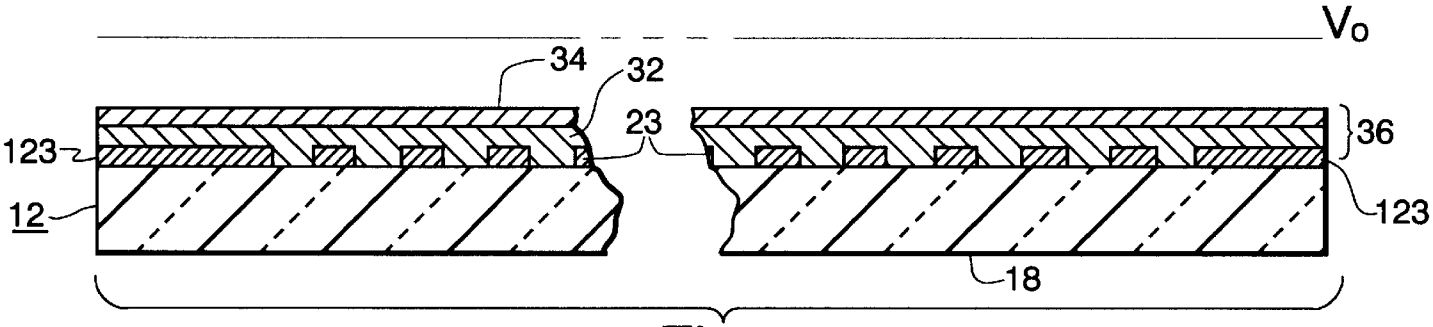
FIG. 4 is a section of the faceplate panel showing the electrostatic charge on an OPC layer at one step in the manufacturing process.
Figure 5:
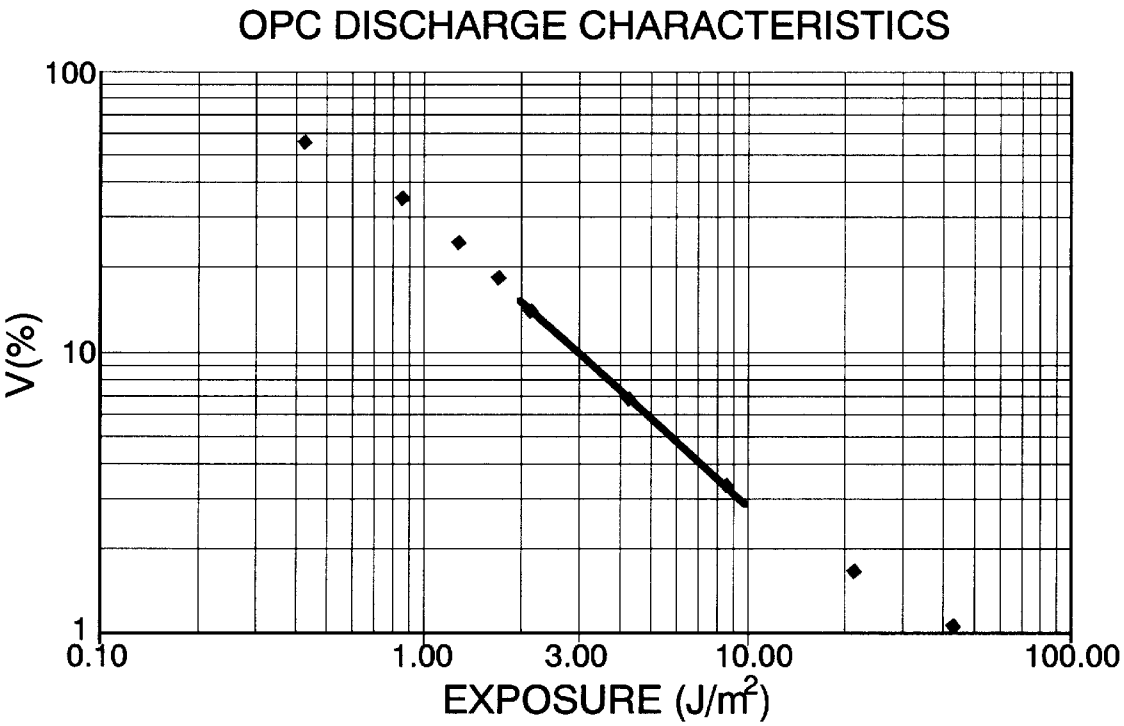
FIG. 5 is a diagram of the discharge characteristics of the OPC layer used in the manufacturing process.

The screen is manufactured by an electrophotographic process that is shown schematically in FIG. 3. Initially, the panel 12 is cleaned, as shown in step 311, by washing it with a caustic solution, rinsing it in water, etching it with buffered hydrofluoric acid and rinsing it again with water, as is known in the art. The interior surface of the viewing faceplate 18 is then provided with the light absorbing matrix 23 and border 123, as shown in step 33, for example using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the shadow mask is inserted into the faceplate panel and the panel is placed onto a three-in-one lighthouse (not shown) which exposes the photoresist layer to actinic radiation from a light source which projects light through the openings in the shadow mask. The exposure is repeated two more times with the light source located to simulate the paths of the electron beams from the three electron guns. The light selectively alters the solubility of the exposed areas of the photoresist layer where phosphor materials will subsequently be deposited. After the third exposure, the panel is removed from the light house and the shadow mask is removed from the panel. The photoresist layer is developed to remove the more soluble areas of the photoresist layer, thereby exposing the underlying interior surface of the faceplate and leaving the less soluble, exposed areas intact. Then, a suitable dispersion of light absorbing material is uniformly provided onto the interior surface of the faceplate to cover the exposed portion of the faceplate and the retained less soluble areas of the photoresist layer. The layer of light absorbing material is dried and developed using a suitable solution which will dissolve and remove the retained portion of the photoresist layer and the overlying light absorbing material, forming windows in the matrix layer and the border which is adhered to the surface of the faceplate. For a faceplate panel 12 having a diagonal dimension of 51 cm (20 inches) the window openings formed in the matrix and shown in FIG. 4, have a width of about 0.13 to 0.18 mm, and the matrix lines have a width of about 0.1 to 0.15 mm. The interior surface of the faceplate panel, having the matrix thereon, is then coated, as indicated in step 35, with a volatilizable organic conductive (OC) material which forms an organic conductive (OC) layer 32 that provides an electrode for an overlying volatilizable organic photoconductive (OPC) layer 34, indicated in step 37. The OC layer 32 and the OPC layer 34 are shown in FIG. 4 and, in combination, comprise a photoreceptor 36. The OPC layer 34 is electrostatically charged, by a corona discharge device, not shown, as indicated in step 39, to a voltage, V., shown in FIG. 4, that is typically about 470 volts. The corona discharge device is described in U.S. Pat. No. 5,519,217, issued on May 21, 1996 to Wilbur et al. The discharge characteristics of the OPC layer 34, when exposed to a pulsed xenon light, are shown in FIG. 5. The faceplate panel 12 is disposed on an exposure device having multiple light positions, as indicated in step 41 of FIG. 3. Then, as indicated in step 43, selected areas of the OPC layer 34 are exposed to visible light from a source within the exposure device, such as a pulsed xenon light, the initial charge on the OPC layer is decreased by an amount that depends on the energy density of the source, which is stated in Joules/$m^2$. As shown in FIG. 5, a single exposure of about 3 Joules/$m^2$ discharges the OPC layer which is initially at 470 volts, to about 10% of its original charge. However, multiple exposures are utilized by applicants to adjust the width of the discharged area of the OPC layer, thereby adjusting the width of the subsequently formed phosphor lines, as described hereinafter.

Figure 6:
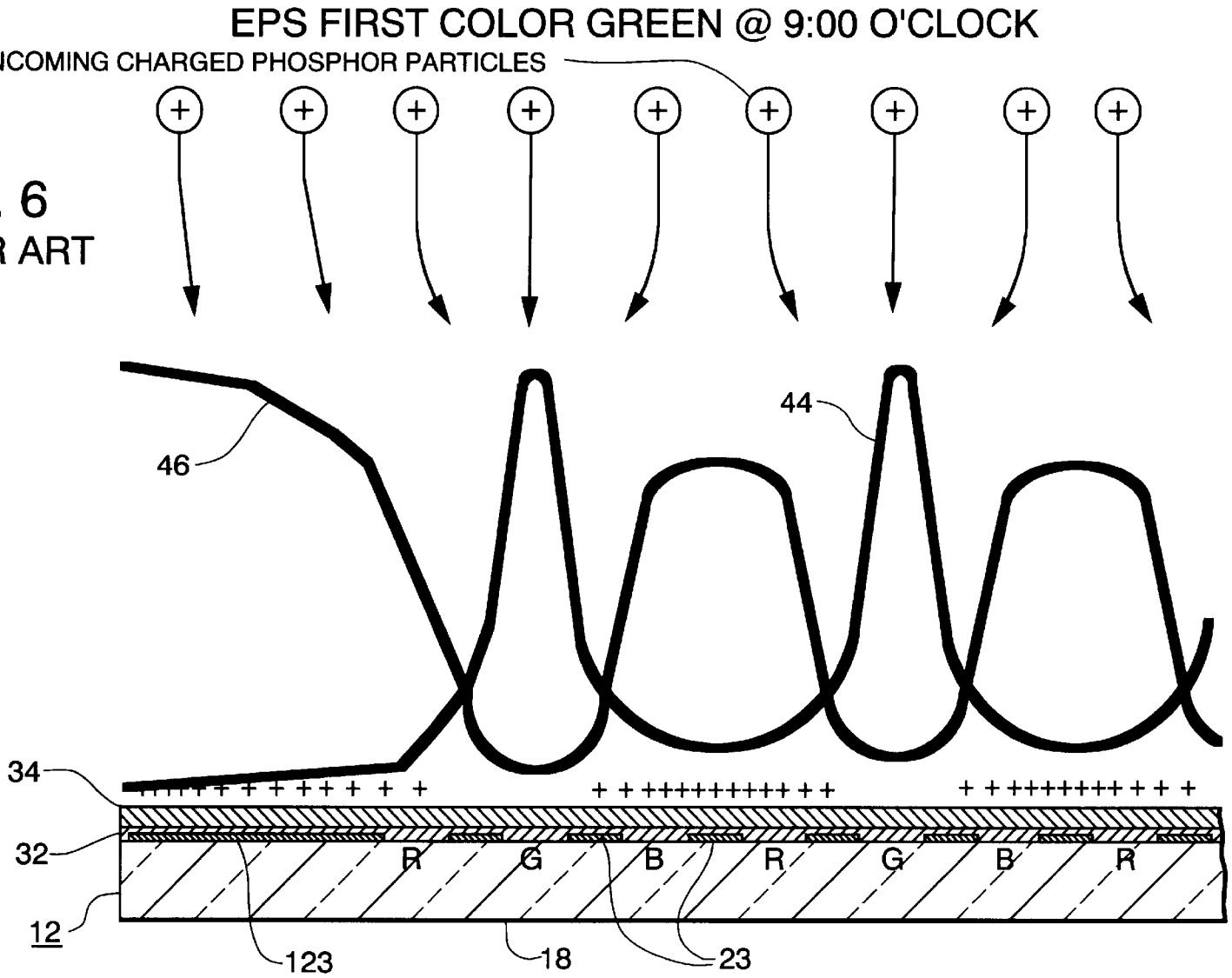
Fig. 6 PRIOR ART
FIGS. 6–8 are diagrams of the Prior Art electrostatic charge on the OPC layer as a result of exposure to each of the three lighthouse positions.

In the prior art, the OPC layer 34 is electrostatically charged and then the shadow mask 25 is inserted into the faceplate panel 12 and the panel is placed onto a conventional lighthouse which exposes the OPC layer 34 to visible light from a light source which projects light through the openings in the shadow mask at an angle that simulates the path of the electron beams from a first electron gun. This exposure method is referred to in the art as first order exposure. The OPC layer 34 is discharged in the areas where the light is incident thereon. As shown in FIG. 6, when the first color phosphor to be deposited on the OPC layer 34 is the green-emitting phosphor, the light exposure, shown by curve 44, discharges the electrostatic potential, shown by curve 46, and creates voltage wells, or depressions, over the useful screen area, where the green phosphor will be deposited. The last voltage well, adjacent to the matrix border 123, at the 9 o'clock location on the screen, is asymmetric because the potential of curve 46 is greater over the matrix border 123 than over the active screen area where the voltage wells are symmetric. During EPS development, a nominally uniform flux of positively charged phosphor particles is directed toward the selectively discharged OPC layer 34. Over most of the active screen area, the OPC layer discharge pattern is periodic; therefore, the post-exposure charge, electrostatic potential, and force, distributions also are periodic. The positively charged phosphor particles are repelled by the more positively charged, unexposed areas of the OPC layer 34 and deposited into the discharged voltage wells, by a process known as reversal development. However, at the matrix border, for example at the 9 o'clock side of the pattern, shown in FIG. 6, the periodicity of the charge pattern no longer holds and last line asymmetry results in nonuniform deposition of the green phosphor which is more strongly repelled by the higher positive voltage present over the matrix border 123.

Figure 7:
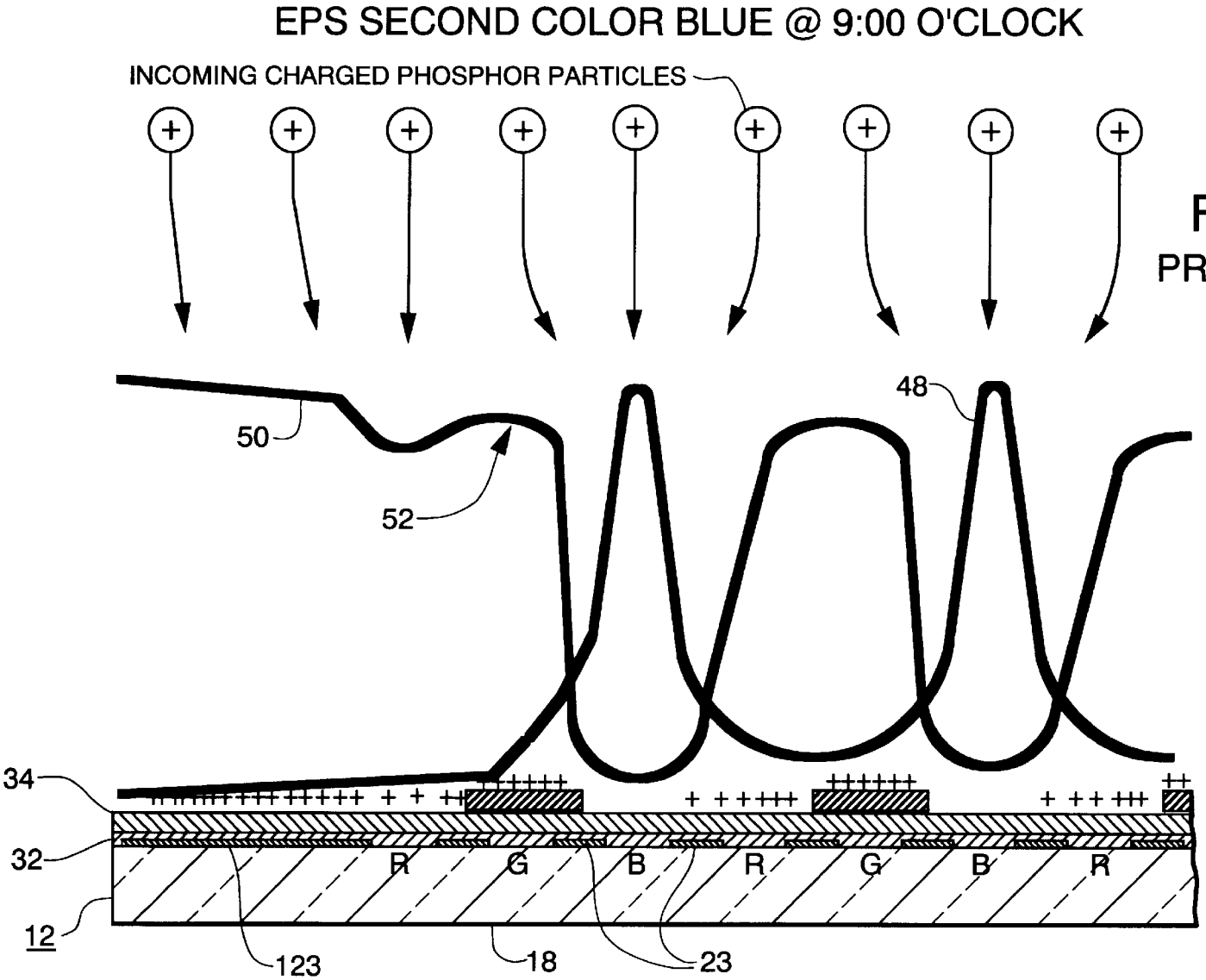
Fig. 7 PRIOR ART

A similar problem is encountered during the deposition of the second and third phosphors. As shown in FIG. 7, in order to deposit the second, e.g., blue color-emitting phosphor, the OPC layer 34 is recharged and light discharged through the shadow mask with the light source located to simulate the path of the electron beams from the gun which excites the blue phosphor. The light exposure, shown by curve 48, discharges the electrostatic potential, shown by curve 50, and creates voltage wells, or depressions, over the useful screen area, where the blue phosphor will be deposited. The last voltage well, adjacent to the matrix border 123 is asymmetric because the potential of curve 50 is greater over the matrix border than over the active screen area where the voltage wells are symmetric. Additionally, during the first order exposure of the areas where the blue phosphor is to be deposited, scattered light partially discharged the OPC layer 34 over the last matrix opening adjacent to the matrix border. In the present deposition scheme, this last line is to be occupied by red-emitting phosphor. However the partial discharge over the last matrix opening permits at least some blue-emitting phosphor to be deposited in that last matrix opening and results in cross contamination with the red-emitting phosphor which is deposited last. Also, over the last green line on the 9 o'clock side, a local voltage peak 52 occurs in the potential curve 50. This local peak 52 results from the electrostatic charge retained by the green-emitting phosphor. During EPS development, a nominally uniform flux of positively charged blue-emitting phosphor particles are directed toward the selectively discharged OPC layer 34. Over most of the active screen area, the OPC layer discharge pattern is periodic; therefore the post-exposure charge, electrostatic potential, and force, distributions are also periodic, and the charged blue-emitting phosphor particles are properly deposited in the voltage wells.

Figure 8:
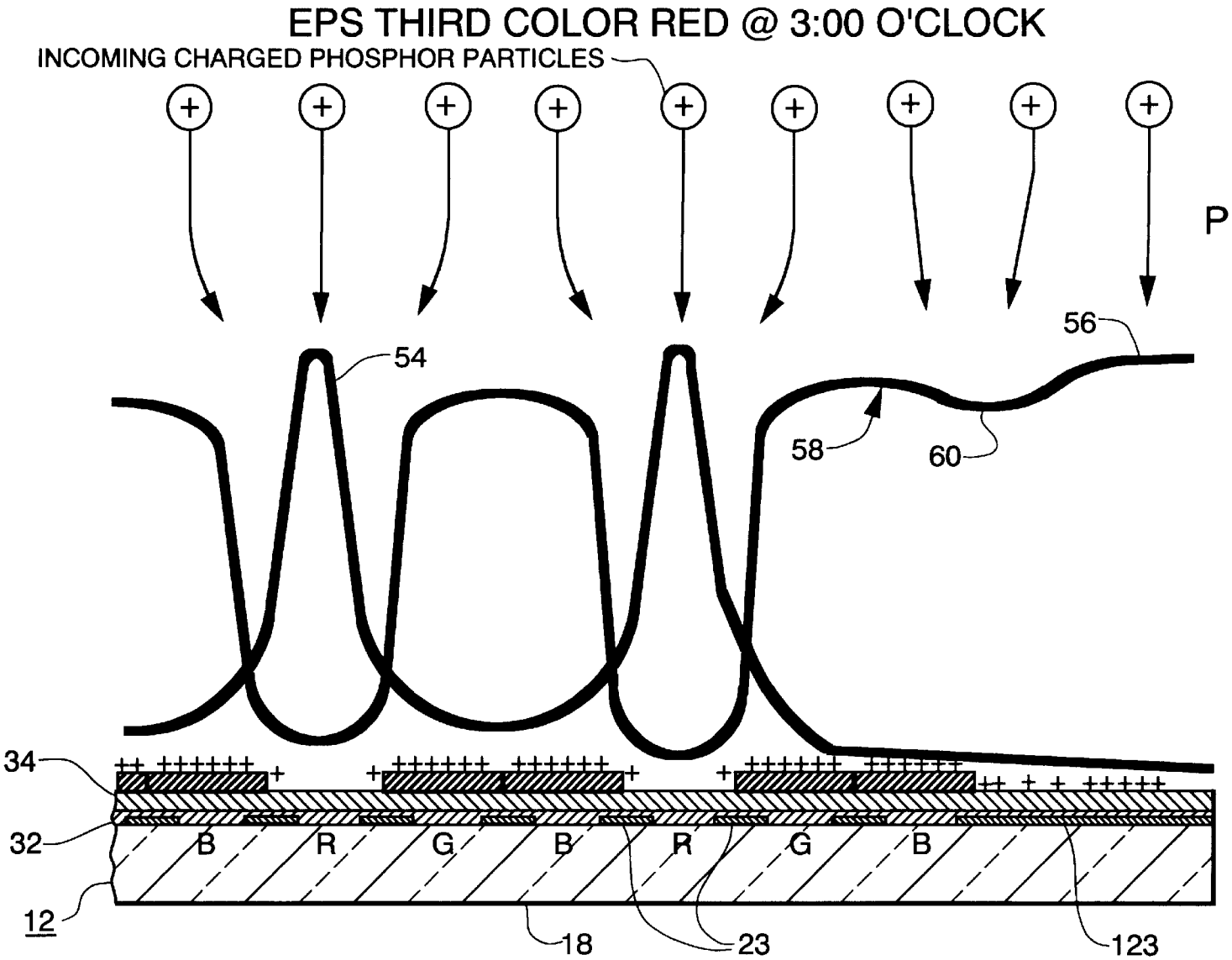
Fig. 8 PRIOR ART

As shown in FIG. 8, in order to deposit the third, e.g., red color-emitting phosphor, the OPC layer 34 is recharged and light discharged through the shadow mask with the light source located to simulate the path of the electron beams from the gun which excites the red phosphor. The light exposure, shown by curve 54, discharges the electrostatic potential, shown by curve 56, and creates voltage wells, or depressions, over the useful screen area, where the red phosphor will be deposited. The last available voltage well, adjacent to the matrix border 123, is relatively symmetric; however, during the first order exposure of the areas where the red phosphor is to be deposited, scattered light partially discharged the OPC layer 34 in the border region adjacent to the last blue-emitting phosphor line adjacent to the matrix border 123 at the 3 o'clock side of the major axis. Also, over the last green and blue lines on the 3 o'clock side, a local voltage peak 58 occurs in the potential curve 56. This local peak 58 results from the electrostatic voltage retained by the green-emitting and blue-emitting phosphors. A shallow depression 60 in the potential curve 56 over the last blue-emitting phosphor line and the generally elevated potential of the OPC layer 34 over the matrix border region 123 may cause some last blue line cross-contamination with the last deposited, red-emitting phosphor. During EPS development, a nominally uniform flux of positively charged red-emitting phosphor particles are directed toward the selectively discharged OPC layer 34. Over most of the active screen area the OPC layer discharge pattern is periodic; therefore the post-exposure charge, electrostatic potential, and force, distributions also are periodic, and the charged red-emitting phosphor particles are properly deposited.

Figures 9, 9A, 9B:
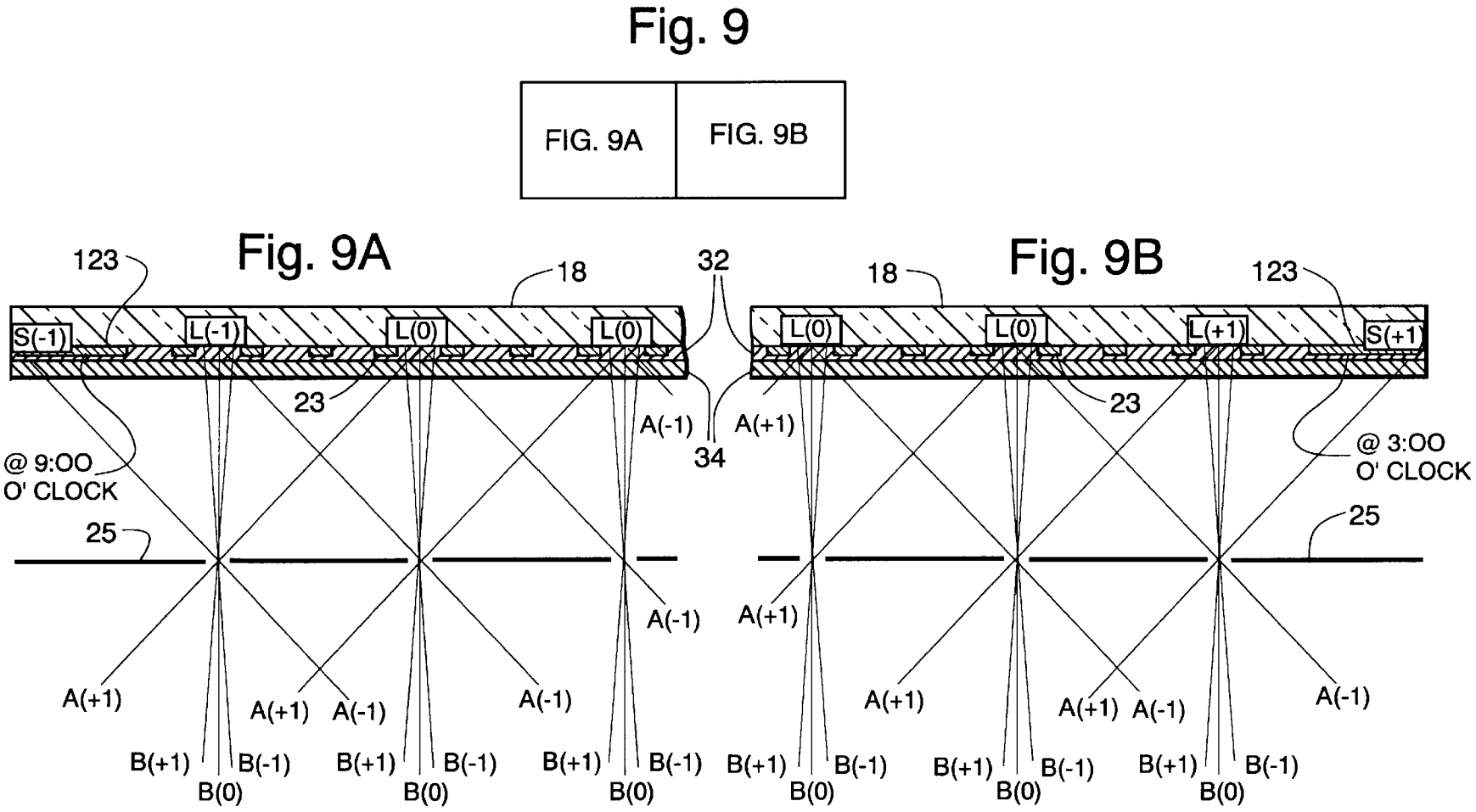
FIG. 9 is a composite diagram showing one novel exposure of the OPC layer using both first and second order light exposures.

To overcome the above-described last line deposition and cross-contamination problem, a combination of first and second order light exposures are utilized. As shown in FIG. 9, the light source may be located at multiple positions to illuminate the OPC layer 34. For example, the first order light exposure may originate from three separate locations, B(0), B(+1) and B(−1), and the second order light exposure may originate from two positions, A(+1) and A(−1). With reference to FIG. 9, the first and second order light exposures that are shown are directed toward the locations in the matrix openings that will subsequently be occupied by the green-emitting phosphors. The resultant exposure patterns on the overlying OPC layer 34 fall into three groups. The first group, S(±1), identified as "border traps", are located on the imperforate border 123 of the matrix. The second group, L(±1), represents the last green-emitting phosphor line on each side of the active screen area. The third group, L(0), represents all other green-emitting lines in the active screen area. As shown in FIG. 9(*a*), at the matrix border at the 9 o'clock location, light from the second order light location A(−1) is incident on the OPC layer 34 overlying the matrix border 123. Correspondingly, in, FIG. 9(*b*), on the matrix border at the 3 o'clock location, light from the second order light location A(+1) is incident on the OPC layer 34 overlying the matrix border. In the last line openings, L(−1), shown in FIG. 9(*a*), light is incident on the overlying OPC layer 34 from a single second order location A(−1) and from three first order locations B(0), and B(±1), and in FIG. 9(*b*), light from second order location A(+1) and from three first order locations B(0), and B(±1) is incident on the OPC layer 34 overlying the last line opening L(+1). Thus, if the number of light pulses utilized in a second order exposure is n, and the number of light pulses utilized in the first order light exposures is N the exposures patterns can be expressed as:

exposures in border traps, S(±1)=n pulses;

exposures in last lines, L(±1)=n+N pulses; and exposures in all other lines, L(0)=2n+N pulses.

If N=0, that is, if only second order light pulses are employed, the last lines, L(±1) would have one half the exposure of all other visible lines, L(0), and the same exposures as the border traps, S(±1). This relatively strong under-exposure makes it somewhat difficult to match the phosphor screen weight and line width of the last lines to that of the other visible lines, L(0), and to the required specifications. Therefore, it is preferable to utilize a relatively strong first order exposure and a relatively weak second order exposure. This approach is supported by two observations: i) the most important function of the second order exposure is to create border traps to collect phosphor particles that otherwise would cause last line cross contamination, and ii) the OPC layer discharge characteristics are such that the depth of the electrostatic wells, created by light discharging the OPC layer 34, are relatively insensitive to the exact light exposure energy, provided that all wells are deep with respect to the original charge voltage, $V_0$.

In the present method, multiple-step exposures, with an offset of the first order light locations are utilized in order to control the phosphor line width. A suitable multi-step exposure schedule is shown in the TABLE.

TABLE

| | | | | | A | Exposure on Screen | | |
|---|---|---|---|---|---|---|---|---|
| | | A(−1) | B(−1) | B(+1) | (+1) | S(±1) | L(±1) | L(0) |
| Green | Flash | 0 | 2 | 2 | 0 | 0 | 4 | 4 |
| Green | Pos. | N.A. | −0.91 −(36) | 0.91 (36) | N.A. | | | |
| Blue | Flash | 1 | 3 | 3 | 1 | 1 | 7 | 8 |
| Blue | Pos. | −16.13 −(635) | −4.32 −(170) | −2.92 −(115) | 9.53 (375) | | | |
| Red | Flash | 2 | 5 | 5 | 2 | 2 | 12 | 14 |
| Red | Pos | −9.58 −(377) | 2.87 (113) | 4.90 (193) | 16.21 (638) | | | |

In the TABLE, "Flash" refers to the number of xenon lamp pulses. One flash is approximately equal to an energy density of 1.5 joules per square meter for the green exposure and about 3.3 joules per square meter for the blue and red exposures. The flash energies were measured with a pyroelectric detector. "Pos." refers to the position of the xenon light source with respect to the fist order green center position. The top line gives the position of the light source in millimeters and the second line gives the position in mils. The corresponding approximate screen position is determined by dividing the position given in the table by 15.

From the TABLE, it is evident that only two first order light source positions, B(±1), were utilized to provide the exposure for deposition of the green-emitting phosphor. No second order light source positions were used during the green exposure. Thus, no green border traps were created and the exposure of the last line, L(±1), was the same as for the other lines, L(0), in the active screen area. However, during the exposure for the blue-emitting phosphor, four light source positions were utilized, a single second order flash was utilized to provide a single exposure for the border traps, S(±1), and three flashes from two first order light positions, B(±1) were utilized to provide the exposure for the blue-emitting phosphor. From the last three columns of the table, labeled "Exposure on Screen", the total exposure can be determined. The energy to create the border traps, S(±1) is one-seventh (1/7th) of the energy to create the last lines, L(±1), and one-eight (1/8th) of the energy used to create all other lines, L(0). During the exposure for the red-emitting phosphor, four light source positions also were utilized, two second order flash was utilized to provide two flash exposure for the border traps, S(±1), and five flash exposures from two first order light positions, B(±1) were utilized to provide the exposure for the other line positions. From the last three columns of the table, labeled "Exposure on Screen", the total exposure can be determined. The energy density to create the border traps, S(±1) is one-sixth (1/6th) of the energy to create the last lines, L(±1), and one-seventh (1/7th) of the energy used to create all other lines, L(0). The relatively low exposure utilized to create the border traps, S(±1), leads to correspondingly low differences in exposure between the last lines, L(±1) and the other visible lines, L(0). The low exposure used to create the traps produced blue and red phosphor lines on the imperforate matrix border 123 that were substantially narrower than the phosphor deposits that formed the visible lines, but the lines formed in the border traps were nevertheless effective in eliminating all objectionable red and blue last line cross-contamination. Furthermore, the small difference in exposure between the last lines, L(±1) and all other visible lines, L(0), produced no significant difference between these lines.

While in the example in the TABLE, no second order exposure and thus, no border traps were provided for the green-emitting phosphor, it has been found to be advantageous to provide border traps for the green-emitting phosphor. Such traps increase the electrostatic symmetry in the last lines, L(±1), by creating a "pseudo last line" in the matrix border on each side. In the absence of such a border trap for the green-emitting phosphor, the last lines, L(±1), tend to be skewed, with the outer edges receiving heavier phosphor deposits than the inner edges, that is, the edges directed toward the center of the screen. FIG. 2 shows a screen with three pseudo last lines, one for each of the color-emitting phosphors on the matrix border 123.

Figure 10:
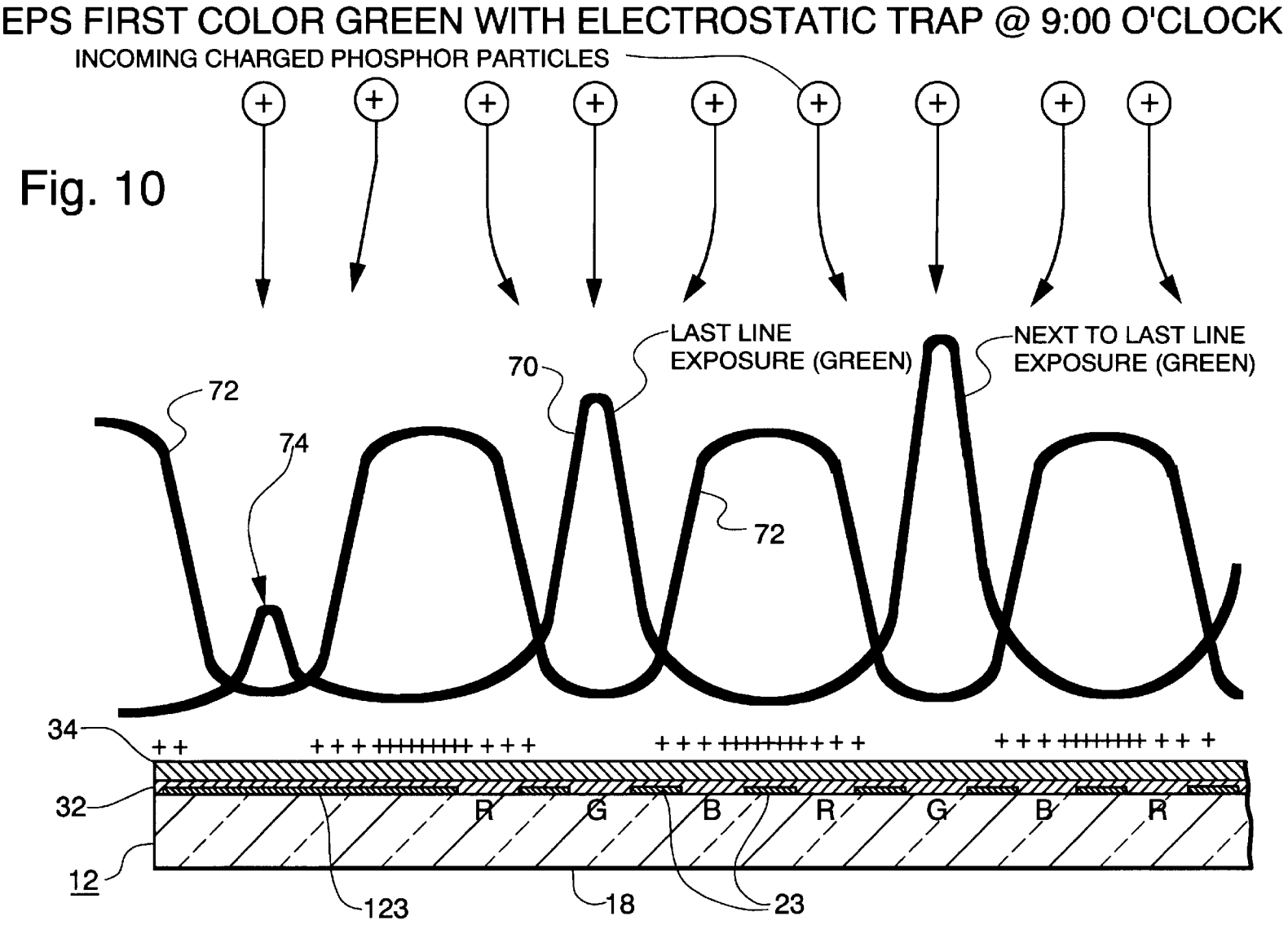
FIGS. 10–12 are diagrams of the electrostatic charge on the OPC layer as the result of first and second order light exposures.
Figure 11:
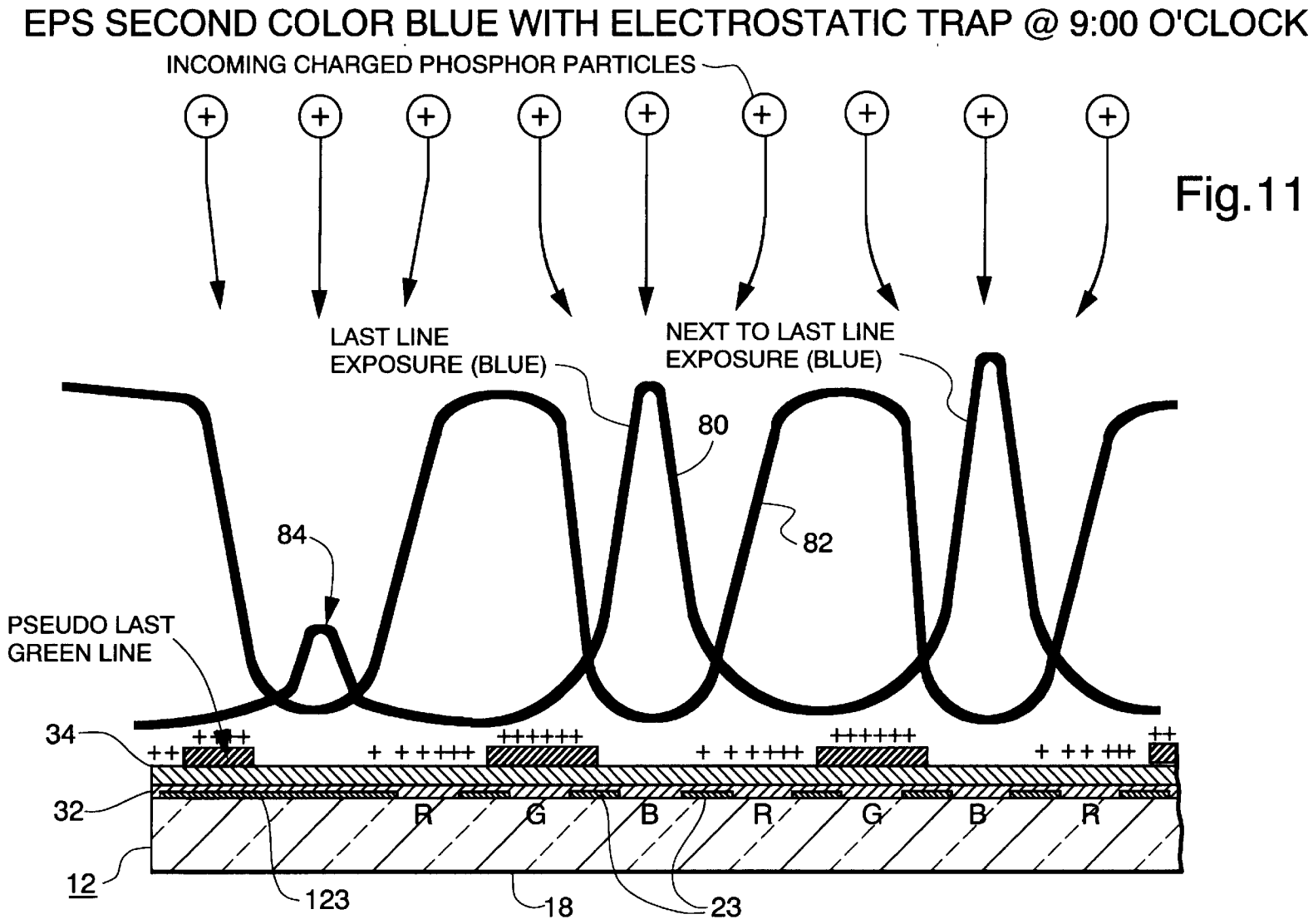
Figure 12:
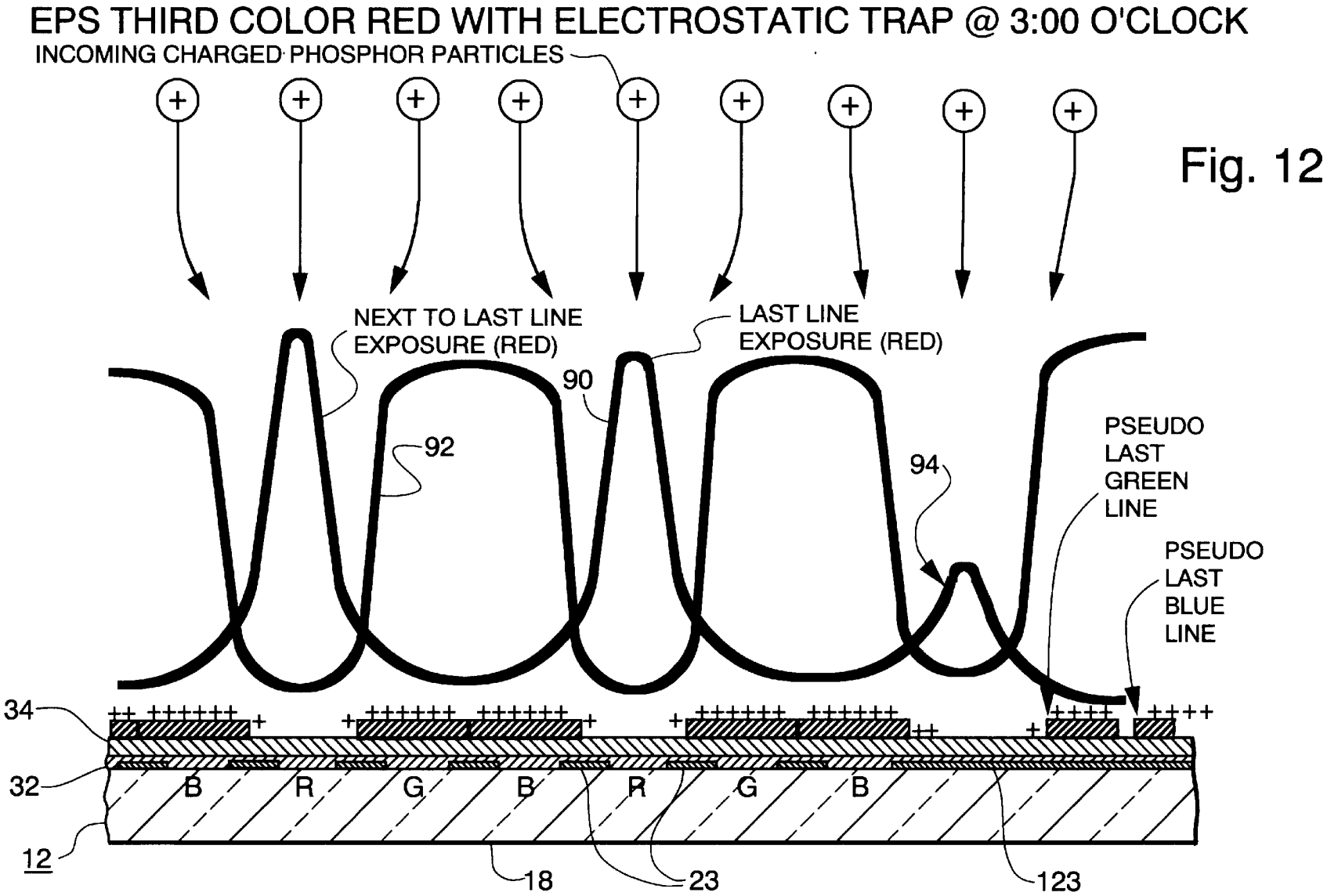

FIGS. 10–12 schematically show the location and function of the border traps for each of the three color-emitting phosphors, in a green, blue, red deposition sequence. In the novel method the OPC layer 34 is electrostatically charged, by the corona discharge device, not shown, to a voltage that is typically about 470 volts. The corona discharge device is described in U.S. Pat. No. 5,519,217, referenced above. The faceplate panel 12 is disposed on an exposure device having multiple light positions, as indicated in step 41 of FIG. 3. Then, as indicated in step 43, selected areas of the OPC layer 34 are exposed, through the shadow mask 25, to visible light from multiple sources within the exposure device, such as a pulsed xenon light, the initial charge on the OPC layer is decreased by an amount that depends on the energy density of the source. Typically, each pulse, or flash, used to discharge the areas where the green-emitting phosphor will be deposited receives an energy density of 1.5 joules/$m^2$, and the areas where the blue- and red-emitting phosphors are to be deposited receive an energy density of 3.3 joules/$m^2$ for each flash.

With reference to FIG. 9 first and second order illumination from light source positions A(±1) and B(±1) illuminate the OPC layer 34, as shown in the light exposure curve 70 of FIG. 10, and partially discharge the electrostatic potential curve 72. The light exposure creates voltage wells, or depressions, over the useful screen area, as well as over the matrix border 123, where the green phosphor will be deposited. The last voltage well, adjacent to the matrix border 123, at the 9 o'clock location on the screen, is now symmetric because the second order illumination, indicated at 74, from light source location A(−1), has also discharged the potential curve 72 over the matrix border 123 creating a well defined border trap. During EPS development, as indicated by step 45 of FIG. 3, a nominally uniform flux of positively charged green-emitting phosphor particles is directed toward the selectively discharged OPC layer 34. The positively charged phosphor particles are repelled by the more positively charged, unexposed areas of the OPC layer 34 and deposited into the discharged voltage wells, by reversal development. At the matrix border 123, for example at the 9 o'clock side of the pattern, shown in FIG. 10, the periodicity of the discharge pattern of curve 72 is now maintained and last line symmetry results in a uniform deposition of the green phosphor in the last line L(−1), while a "hidden" pseudo last green line, shown in FIG. 11, overlying the matrix border 123 is subject to border efficient symmetry. Because the pseudo last line is not visible from the viewing side of the finished CRT, its quality in terms of line width and registration, to name only two parameters, is of no operational significance. The function of the pseudo last line is solely to provide electrostatic symmetry for the last visible line on the screen 22.

As shown in FIG. 11 and indicated in step 47 of FIG. 3, in order to deposit the second, e.g., the blue color-emitting phosphor, the OPC layer 34 is recharged, as indicated in step 49 of FIG. 3, and light discharged through the shadow mask, as indicated in steps 41 and 43, with the first order light source positioned at two closely spaced locations, such as those listed in the TABLE to simulate the path of the electron beams from the gun which excites the blue phosphor. Additionally, second order locations are utilized as indicated in the TABLE. The light exposure, shown by curve 80, discharges the electrostatic potential, shown by curve 82, and creates voltage wells, or depressions, over the useful screen area as well as over the matrix border 123, where the blue phosphor will be deposited. The last voltage well, adjacent to the matrix border 123 is now symmetric because the second order illumination, indicated at 84, from light source location A(−1), has also discharged the potential curve 82 over the matrix border 123 creating a well defined border trap. During BPS development, a nominally uniform flux of positively charged blue-emitting phosphor particles is directed toward the selectively discharged OPC layer 34. The positively charged phosphor particles are repelled by the more positively charged, unexposed areas of the OPC layer 34 and deposited into the discharged voltage wells, by reversal development. At the matrix border 123, for example at the 9 o'clock side of the pattern, shown in FIG. 11, the periodicity of the discharge pattern of curve 82 is now maintained and last line symmetry results in a uniform deposition, without contanmination, of the green phosphor in the last line L(−1), and in a pseudo last blue line, shown in FIG. 12, overlying the matrix border 123.

As shown in FIG. 12 and indicated at step 47 of FIG. 3, in order to deposit the third, e.g., red color-emitting phosphor, the OPC layer 34 is recharged and light discharged through the shadow mask, as indicated in steps 41 and 43, with the first order light source located at two or more locations, such as those listed in the TABLE, to simulate the path of the electron beams from the gun which excites the red phosphor. Additionally, two second order light locations are also utilized. The light exposures, shown by curve 90, discharge the electrostatic potential, shown by curve 92, and creates voltage wells, or depressions, over the useful screen area as well as over the matrix border 123, where the red phosphor will be deposited. The last available voltage well, adjacent to the matrix border 123, is also symmetric because the second order illumination, indicated at 94, from light source location A(±1), in FIG. 9, creates a border trap at the 3 o'clock side of the major axis. During EPS development, a nominally uniform flux of positively charged red-emitting phosphor particles is directed toward the selectively discharged OPC layer 34. The positively charged phosphor particles are repelled by the more positively charged, unexposed areas of the OPC layer 34 and deposited into the discharged voltage wells, by reversal development. At the matrix border 123, for example at the 3 o'clock side of the pattern, shown in FIG. 12, the periodicity of the discharge pattern of curve 92 is now maintained and last line symmetry results in a uniform deposition, without. contamination, of the red phosphor in the last line L(−1), and in a pseudo last red line, not shown, overlying the matrix border 123.

The three phosphors are fused, as indicated in step 49 of FIG. 3, to the OPC layer 34 of the photoreceptor 36 by contacting the materials with the vapor of a suitable solvent, in the manner described in U.S. Pat. No. 4,917,978, issued to Ritt et al. on Apr. 17, 1990. The screen structure is then spray-filmed and aluminized, as indicated in steps 51 and 53, respectively, to form the luminescent screen assembly. The screen assembly is baked at a temperature of about 425° C. for about 30 minutes, as indicated in step 55, to drive off the volatilizable constituents of the screen assembly.

The multiple first order exposures, B(±1), in the foregoing example serve to optimally position and shape the phosphor deposits over the openings in matrix 23, that make up the viewing screen 22. For example, if only a single first order beam, B(0), were used, the necessary phosphor line width and screen weight would be difficult to maintain over the entire viewing screen 22, and very tight control of the corona charging uniformity would be required. Also, careful adjustment of the exposure distribution and frequent adjustment of the exposure levels would be needed. However, in the present method, optimized B(±1) positions and exposure levels are empirically determined. Such optimized multi-step first order B(±1) exposures have been found to reduce the phosphor deposit sensitivity to corona charging uniformity and exposure distribution. Also the optimized B(±1) positions reduce the required light exposure levels so that improved process flexibility is obtained.

In the EPS process, the second and third color-emitting phosphors are deposited into periodic potential wells over the viewing area of the screen. Such potential wells show certain asymmetries due to the charge retention of the prior deposited phosphors during the deposition of the second and third color-emitting phosphors. In the present invention, the multi-step first order light exposure has been found to be effective in obtaining good matrix opening coverage, across the entire screen area, in the presence of asymmetric electrostatic repulsion caused by the prior deposited phosphors. By having at least two adjustable exposure positions, it has been found effective to set up the empirically determined lighthouse positions so that one position is selected by assuring good coverage on one edge of the matrix openings, typically the edge located farthest from the electrostatically repelling phosphor, and the second lighthouse position is selected by assuring good coverage at the other, or closest, edge of the matrix openings.

What is claimed is:

1. A method of electrophotographically manufacturing a luminescent line screen within a viewing area of a faceplate panel of a CRT, an interior surface of said faceplate panel having a matrix thereon with a photoreceptor overlying said matrix, said matrix having a border extending beyond said viewing area of said line screen, said faceplate panel having a major axis and a minor axis, comprising the steps of:

charging said photoreceptor to establish a substantially uniform electrostatic voltage thereon;

positioning said panel, with a color selection electrode having a multiplicity of openings therethrough mounted therein, on an exposure device having a multi-position visible light source and exposing from at least one position of said light source, through the openings in said color selection electrode, selected areas of said photoreceptor within said viewing area at an angle substantially identical to the angle of the incident electron beam from a first electron gun within said CRT;

removing said color selection electrode from said panel;

depositing a triboelectrically charged first color-emitting phosphor onto said illuminated areas of said photoreceptor;

recharging said photoreceptor and said first color-emitting phosphor with an electrostatic voltage, the voltage on said photoreceptor being different from the voltage on said first color-emitting phosphor;

repositioning said panel, with said color selection electrode mounted therein, on said exposure device having said multi-position visible light source, and exposing from at least one position of said light source, through the openings in said color selection electrode, selected areas of said photoreceptor within said viewing area at an angle substantially identical to the angle of the incident electron beam from a second electron gun within said CRT, two other of said positions of said light source being displaced by a distance such that the light source images projected through the openings in said color selection electrode provide an offset of one pitch upon selected areas of said photoreceptor within said viewing area as well as a first area outside said viewing area on one side of said major axis, within the border of said matrix;

removing said color selection electrode from said panel;

depositing a triboelectrically charged second color-emitting phosphor onto said illuminated areas of said photoreceptor;

recharging said photoreceptor and said first and second color-emitting phosphors with an electrostatic voltage, the voltage on said photoreceptor being different from the voltages on said first and second color-emitting phosphors;

repositioning said panel, with said color selection electrode mounted therein, on said exposure device having said multi-position visible light source, and exposing from at least one position of said light source, through the openings in said color selection electrode, selected areas of said photoreceptor within said viewing area at an angle substantially identical to the angle of the incident electron beam from a third electron gun within said CRT, two other of said positions of said light source being displaced by a distance such that the light source images projected through the openings in said color selection electrode provide an offset of one pitch upon selected areas of said photoreceptor within said viewing area as well as a second area outside said viewing area on one side of said major axis, within the border of said matrix;

removing said color selection electrode from said panel; and depositing a triboelectrically charged third color-emitting phosphor onto said illuminated selected areas of said photoreceptor to form a luminescent screen.

2. The method as described in claim 1, including the additional steps of:

(a) fusing said phosphors to said photoreceptor of said luminescent screen;

(b) filming the fused screen;

(c) aluminizing the filmed screen; and (d) baking the aluminized screen to remove the volatilizable constituents therefrom to form a luminescent screen assembly.

3. A method of electrophotographically manufacturing a luminescent line screen within a viewing area of a faceplate panel of a CRT, an interior surface of said faceplate panel having a matrix thereon with a photoreceptor overlying said matrix, said matrix having a border extending beyond said viewing area of said line screen, said faceplate panel having a major axis and a minor axis, comprising the steps of:

charging said photoreceptor to establish a substantially uniform electrostatic voltage thereon;

positioning said panel, with a color selection electrode having a multiplicity of openings therethrough mounted therein, on an exposure device having at least a four position visible light source, at least two of said four positions of said light source being adjacent to each other but substantially identical to the angle of the incident electron beam from a first electron gun within said CRT for exposing, through the openings in said color selection electrode, selected areas of said photoreceptor within said viewing area, two other of said four positions of said light source being displaced by a distance such that the light source images projected through the openings in said color selection electrode provide an offset of one pitch upon selected areas of said photoreceptor within said viewing area as well as a first area outside said viewing area on at least one side of said major axis, within the border of said matrix;

removing said color selection electrode from said panel;

depositing a triboelectrically charged first color-emitting phosphor onto said illuminated areas of said photoreceptor as well as onto said first area outside said viewing area;

recharging said photoreceptor and said first color-emitting phosphor with an electrostatic voltage, the voltage on said photoreceptor being different from the voltage on said first color-emitting phosphor;

repositioning said panel, with said color selection electrode mounted therein, on said exposure device having said at least four position visible light source, at least two of said four positions of said light source being adjacent to each other but substantially identical to the angle of the incident electron beam from a second electron gun within said CRT for exposing, through the openings in said color selection electrode, selected areas of said photoreceptor within said viewing area, two other of said at least four positions of said light source being displaced by a distance such that the light source images projected through the openings in said color selection electrode provide an offset of one pitch upon selected areas of said photoreceptor within said viewing area as well as a second area outside said viewing area on at least one side of said major axis, within the border of said matrix;

removing said color selection electrode from said panel;

depositing a triboelectrically charged second color-emitting phosphor onto said illuminated areas of said photoreceptor;

recharging said photoreceptor and said first and second color-emitting phosphors with an electrostatic voltage, the voltage on said photoreceptor being different from the voltages on said first and second color-emitting phosphors;

repositioning said panel, with said color selection electrode mounted therein, on said exposure device having said at least four position visible light source, at least two of said four positions of said light source being adjacent to each other but substantially identical to the angle of the incident electron beam from a third electron gun within said CRT for exposing, through the openings in said color selection electrode, selected areas of said photoreceptor within said viewing area, two other of said at least four positions of said light source being displaced by a distance such that the light source images projected through the openings in said color selection electrode provide an offset of one pitch upon selected areas of said photoreceptor within said viewing area as well as a third area outside said viewing area on at least one side of said major axis, within the border of said matrix;

removing said color selection electrode from said panel; and depositing a triboelectrically charged third color-emitting phosphor onto said illuminated selected areas of said photoreceptor to form a luminescent screen.

4. The method as described in claim 3, including the additional steps of:

(a) fusing said phosphors to said photoreceptor of said luminescent screen;

(b) filming the fused screen;

(c) aluminizing the filmed screen; and (d) baking the aluminized screen to remove the volatilizable constituents therefrom to form a luminescent screen assembly.

5. A method of electrophotographically manufacturing a luminescent line screen within a viewing area of a faceplate panel of a CRT, an interior surface of said faceplate panel having a matrix thereon with a photoreceptor overlying said matrix, said matrix having a border extending beyond said viewing area of said line screen, said faceplate panel having a major axis and a minor axis, comprising the steps of:

charging said photoreceptor to establish a substantially uniform electrostatic voltage thereon;

positioning said panel, with a color selection electrode having a multiplicity of openings therethrough mounted therein, on an exposure device having a five position visible light source, three of said positions being transversely spaced from each other but substantially identical to the angle of the incident electron beam from a first electron gun within said CRT for exposing, through the openings in said color selection electrode, selected areas of said photoreceptor within said viewing area, two other of said positions being displaced by a distance such that the light source images projected through the openings in said color selection electrode provide an offset of one pitch upon selected areas of said photoreceptor within said viewing area as well as a first area outside said viewing area on one side of said major axis, within the border of said matrix;

removing said color selection electrode from said panel;

depositing a triboelectrically charged first color-emitting phosphor onto said illuminated areas of said photoreceptor as well as onto said first area outside said viewing area;

recharging said photoreceptor and said first color-emitting phosphor with an electrostatic voltage, the voltage on said photoreceptor being different from the voltage on said first color-emitting phosphor;

repositioning said panel, with said color selection electrode mounted therein, on said exposure device having said position visible light source, three of said positions being transversely spaced from each other but substantially identical to the angle of the incident electron beam from a second electron gun within said CRT for exposing, through the openings in said color selection electrode, selected areas of said photoreceptor within said viewing area, two other of said positions being displaced by a distance such that the light source images projected through the openings in said color selection electrode provide an offset on one pitch upon selected areas of said photoreceptor within said viewing area as well as a second area outside said viewing area one side of said major axis, within the border of said matrix;

removing said color selection electrode from said panel;

depositing a triboelectrically charged second color-emitting phosphor onto said illuminated areas of said photoreceptor;

recharging said photoreceptor and said first and second color-emitting phosphors with an electrostatic voltage, the voltage on said photoreceptor being different from the voltages on said first and second color-emitting phosphors;

repositioning said panel, with said color selection electrode mounted therein, on said exposure device having said five position visible light source, three of said positions being transversely spaced from each other but substantially identical to the angle of the incident electron beam from a third electron gun within said CRT for exposing, through the openings in said color selection electrode, selected areas of said photoreceptor within said viewing area, two other of said positions being displaced by a distance such that the light source images projected through the openings in said color selection electrode provide an offset of one pitch upon selected areas of said photoreceptor within said viewing area as well as a third area outside said viewing area on one side of said major axis, within the border of said matrix;

removing said color selection electrode from said panel; and depositing a triboelectrically charged third color-emitting phosphor onto said illuminated selected areas of said photoreceptor to form a luminescent screen.

6. The method as described in claim 5, including the additional steps of:

(a) fusing said phosphors to said photoreceptor of said luminescent screen;

(b) filming the fused screen;

(c) aluminizing the filmed screen; and (d) baking the aluminized screen to remove the volatilizable constituents therefrom to form a luminescent screen assembly.

* * * * *